US009052156B2

(12) United States Patent
Nevils et al.

(10) Patent No.: US 9,052,156 B2
(45) Date of Patent: Jun. 9, 2015

(54) INTEGRATED BIPOD TENSION STABILIZATION RIFLE SLING

(71) Applicants: Jacques A. Nevils, Fayetteville, NC (US); Chance J. Giannelli, Hope Mills, NC (US)

(72) Inventors: Jacques A. Nevils, Fayetteville, NC (US); Chance J. Giannelli, Hope Mills, NC (US)

( * ) Notice: Subject to any disclaimer, the term of this patent is extended or adjusted under 35 U.S.C. 154(b) by 125 days.

(21) Appl. No.: 13/853,720

(22) Filed: Mar. 29, 2013

(65) Prior Publication Data

US 2014/0290108 A1 Oct. 2, 2014

(51) Int. Cl.
*F41C 23/02* (2006.01)
*F41C 33/00* (2006.01)

(52) U.S. Cl.
CPC ..... *F41C 33/001* (2013.01); *Y10S 224/913* (2013.01)

(58) Field of Classification Search
CPC ..... F41C 33/001; Y10S 224/913
USPC ..... 224/149–150, 913; 42/85, 94
See application file for complete search history.

(56) References Cited

U.S. PATENT DOCUMENTS

| | | | | | |
|---|---|---|---|---|---|
| 1,396,270 | A * | 11/1921 | Grierson | 224/150 |
| 1,446,058 | A * | 2/1923 | Neilly | 224/150 |
| 2,032,342 | A * | 3/1936 | Albree | 224/150 |
| 2,296,733 | A * | 9/1942 | Paolino | 224/150 |
| 2,985,980 | A * | 5/1961 | Broshous | 42/94 |
| 3,927,808 | A * | 12/1975 | Steen | 224/267 |
| 5,082,155 | A * | 1/1992 | Salvador | 224/150 |
| 5,715,979 | A * | 2/1998 | Crandall | 224/150 |
| 5,971,239 | A * | 10/1999 | Marable | 224/150 |
| 6,851,516 | B2 * | 2/2005 | Petzl et al. | 182/3 |
| 7,954,272 | B2 * | 6/2011 | Potterfield et al. | 42/94 |
| 7,959,046 | B2 * | 6/2011 | Burnsed et al. | 224/150 |
| 2005/0236444 | A1 * | 10/2005 | Thompson | 224/150 |
| 2006/0137233 | A1 * | 6/2006 | Meeks | 42/94 |
| 2007/0278261 | A1 * | 12/2007 | Gallagher | 224/150 |
| 2011/0186603 | A1 * | 8/2011 | Alford | 224/150 |
| 2012/0255976 | A1 * | 10/2012 | Dees | 224/150 |
| 2014/0203053 | A1 * | 7/2014 | Rivas-Schlanger | 224/150 |
| 2014/0263489 | A1 * | 9/2014 | Hendricks | 224/150 |

* cited by examiner

*Primary Examiner* — Justin Larson
*Assistant Examiner* — Scott McNurlen
(74) *Attorney, Agent, or Firm* — James L. Jackson

(57) ABSTRACT

A firearm sling apparatus has a firearm connection section for attachment to a forward portion of a firearm and having a body connection section for attachment to the body of a firearm user. A releasable latching connector establishes releasable connection of the firearm connection section and the body connection section and provides for selective adjustment of strap members of the sling, permitting a user to adjust the body connection of the sling to fit the user's body anatomy and to accommodate the aiming and shooting position of the firearm. Adjustment of the sling apparatus is preferably accomplished with the user in a bipod stabilized position.

4 Claims, 5 Drawing Sheets

INTEGRATED BIPOD TENSION STABILIZATION RIFLE SLING

BACKGROUND OF THE INVENTION

1. Field of the Invention

The present invention relates generally to shoulder fired firearms, such as rifles, shotguns and various types of tactical weapons. More particularly, the present invention concerns an adjustable sling device for a class of firearms typically referred to as "long guns" or "shoulder fired weapons" that enables shoulder fired weapons to be held tightly against the shoulder of the user during aiming and firing and causing the firearm to be returned substantially to its aiming position after the recoil impact of the firearm against the shoulder of the user has dissipated. Even more specifically, the present invention concerns a sling for long guns having a bipod mounted to the front portion thereof, the sling having a facility for attachment to the bipod and being easily adjustable for developing a traction force to urge the buttstock of the firearm against the shoulder of the user for aiming and firing of the firearm.

2. Description of the Prior Art

Various types of firearm slings have been developed over a long period of time, typically for the purpose of facilitating ease of manually transporting the firearms. However, many firearm slings have been developed that can be set or adjusted to assist users in stabilizing and aiming firearms at the standing position, sitting position and the prone position. When a long gun, such as a rifle, is being used for long range shooting, where stabilized precision aiming of the rifle is critical to the accuracy and repeatability of the shooting activity, typical military type adjustable rifle slings are generally preferred. However, these types of slings are difficult to use and they typically permit a small degree of rifle movement during aiming and firing, and thus permit a certain degree of inaccuracy from the standpoint of bullet strike consistency.

Most of the adjustable slings of the prior art do not function to draw or urge the buttstock of a rifle tightly against the shoulder of the user, thus requiring the user to apply a manual pulling force to the rifle structure to hold the rifle tightly against the shoulder during aiming and shooting. The muscle energy that is used for pulling and stabilizing the rifle during aiming typically interferes somewhat with the delicate digital force that is typically used for carefully pulling the trigger of the rifle in sequence with maintaining the aiming point with respect to the target. Therefore, it is desirable to provide means for increasing the rearward pressure of a firearm against the shoulder of a user for stabilization for aiming and firing activity and for recoil force management, especially to enable highly accurate repetitive firing activities.

Various types of bipod mechanisms have also been developed over the years for assisting in supporting and stabilizing the forward part of a rifle when the rifle is used in a bipod stabilized position or when the forward part of a rifle is supported by some object when the user is standing, kneeling or sitting. Bipod devices are frequently employed when a rifle is being used for precision aiming and shooting activity. For the most part these bipod mechanisms are intended for attachment to forward parts of a rifle, such as being attached to the barrel or forearm. In the case of tactical rifles, such as the AR-15, a preferred position for bipod attachment is the lower forward end portion of the handguard that extends forwardly from the receiver of the firearm and encloses a major portion of the barrel. Typically, the bipod devices have a pair of downwardly extending legs that are arranged in downwardly diverging angulated relation and have ground engaging foot members at the lower end of each of the legs. For the purpose of rifle support and aiming, the foot members of each of the bipod legs are positioned in engagement with the ground or another suitable surface to stabilize and steady the forward part of the rifle. The user will position the buttstock of the rifle against the user's shoulder and raise or lower the buttstock of the rifle for precision aiming of the rifle in elevation. For aiming of the rifle from the standpoint of windage, the user will adjust the position of the buttstock, right or left as needed to align the sights with respect to the target.

For efficiency and precision aiming of a rifle and for maintaining the sights or sighting device of the rifle on target, it is desirable to provide a device, such as a rifle sling, that will facilitate drawing or urging the buttstock of a rifle user against the shoulder of the user with sufficient force to enhance the stability and steadiness of the rifle and facilitate precision aiming and efficient trigger control for precision shooting activity.

SUMMARY OF THE INVENTION

It is a principal feature of the present invention to provide a novel rifle sling that can be easily and efficiently adjusted by a rifle user for application of a desired pulling or urging force of the buttstock against the shoulder of the user to enhance the stability and steadiness of the rifle during aiming and shooting.

It is another feature of the present invention to provide a novel rifle sling that is designed for engagement with each of the legs of a bipod for additional stability of the rifle during use particularly in the prone or other bipod stabilized aiming and shooting position.

It is also a feature of the present invention to provide a novel method for using adjustment features and strap positioning of a rifle sling to facilitate precision aiming and shooting of rifles and other long guns, and which is adjustable to provide a traction force that develops enhanced leverage to the rearward pressure of the firearm against the shoulder of the user for both stabilization for firing and recoil force management.

Briefly, the various objects and features of the present invention are realized through the provision of an adjustable firearm sling assembly having a firearm attachment part thereof that is designed for attachment to a firearm. The sling mechanism is designed for applying a tension force to the firearm to urge the firearm rearwardly, toward the user, so that the buttstock of the firearm is forced against a shoulder of the user with sufficient tightness that the efficiency and accuracy of aiming and shooting are enhanced. The tightness of the sling mechanism also enhances quick and efficient return of the firearm essentially to the aiming and shooting position following dissipation of the sudden recoil force that results from discharging the firearm. The recoil force is efficiently managed so that the sighting system of the firearm will be nearly on target as soon as the recoil force has dissipated. The firearm user will need to make only minor adjustment of the position of the firearm following the firing of each ammunition round, thus simplifying the successive firing of multiple rounds. These features are considered to be highly desirable, especially when the user is engaged in long range firearm shooting matches.

The sling mechanism basically incorporates two sections, a firearm connection section and a shooters body connection section. According to the preferred embodiment of the invention these sling sections are selectively connected by a quick disconnect latching mechanism, or buckle, so that they can be easily engaged and latched or released and separated as desired by the user. Each of the two basic sections of the sling mechanism are adjustable so that the user can easily tailor the fit of the sling mechanism to the firearm and to the user's body anatomy. The user can connect the firearm connection section to the firearm and can then assemble the shooter's body connection section to the user's body. The user will assume a desired firearm aiming and shooting position and will establish connection of the quick disconnect latching mechanism simply by engagement of its latch sections. With this done, the user can then adjust the fit of the various strap sections of the firearm sling by applying a manual pulling force to the free ends of the strap adjustment sections to tighten or loosen the connections of the strap sections as desired. The adjustment strap sections will be manipulated or adjusted until the firearm sling applies a pulling force on the firearm, causing the buttstock of the firearm to be drawn into tight engagement with a shoulder of the user. This sling adjustment process will typically require only a few seconds of time to complete. After the sling has been adjusted for desired fit with the anatomy of a particular user, it will only be necessary to assemble the quick disconnect latch device in order to proceed with aiming and shooting of the firearm.

According to an alternative embodiment of the present invention, the tension stabilizing firearm sling has a firearm connection and a user's body connection section that are not separable, but are connected by a connecting strap. The connection strap may incorporate an elastic section if desired and will have a strap adjustment device that is employed to adjust the tension that is applied between the two sling sections.

The efficiency of aiming and shooting the firearm is enhanced by achieving desired tightness of the firearm sling. Upon discharge of the firearm the recoil impact of the firearm against the shoulder of the user will drive the user's shoulder rearwardly to a known extent. As the recoil energy is dissipated, the user's body structure will essentially return to the aiming position, thus causing the sighting device of the firearm to return automatically to an "on target" position. Aiming, shooting and rapid firing activities of the firearm are significantly enhanced through use of this novel firearm sling mechanism.

The firearm sling of the present invention is particularly designed for efficient use with a firearm having a bipod mechanism attached thereto. However, the firearm sling is also designed for efficient use under circumstances where the firearm is not provided with a bipod. The sling mechanism also includes a strap section having a swivel mount pin or button in assembly therewith, which provides for single point swivel connection of the sling with a firearm having a swivel receptacle.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a side elevation view showing a firearm user in a bipod stabilized aiming and shooting position and employing an adjustable sling embodying the principles of the present invention;

FIG. 2 is a view showing the firearm sling of FIG. 1 separated from the firearm and the marksman, thus showing the sling in greater detail;

FIG. 3 is a view similar to the view of FIG. 2 and showing the firearm connecting section and the user connecting section of the firearm sling being separated by release of a latching buckle or other releasable connecting device;

FIG. 4 is a view showing an intermediate portion of the firearm sling of FIGS. 1-3 and emphasizing the releasable connection buckle, which is shown in its connected and secured condition;

Figure 5:
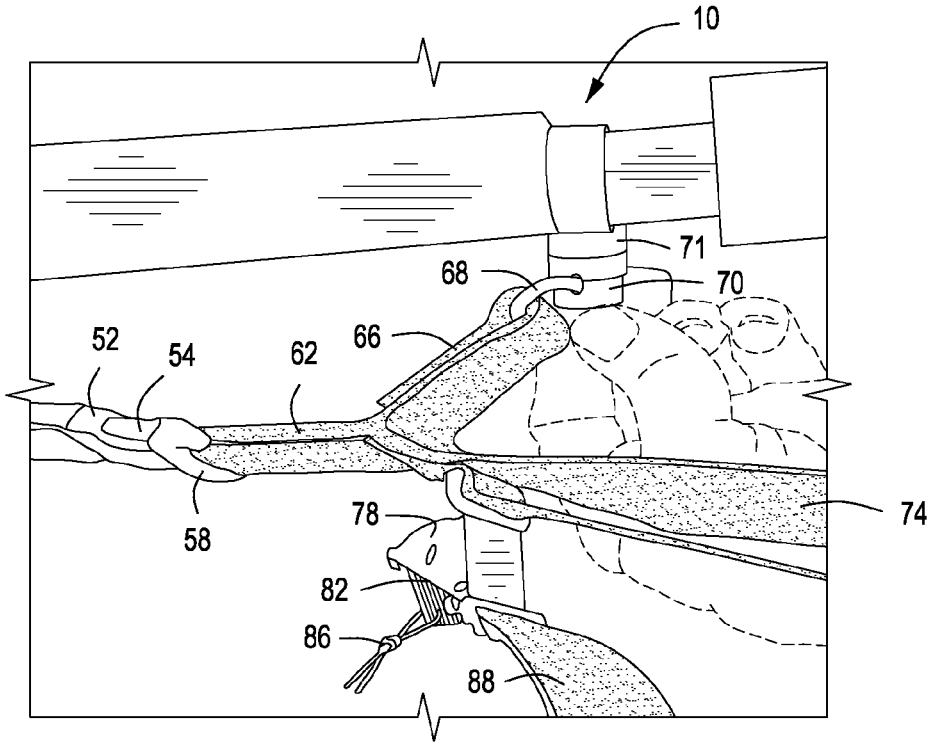
Figure 6:
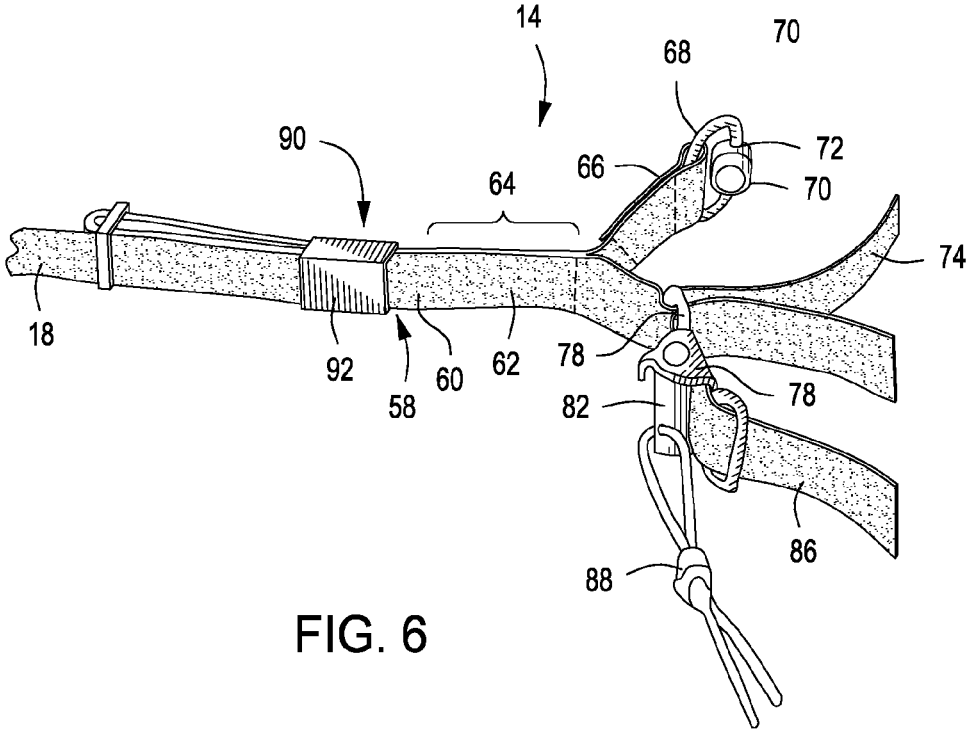

FIG. 5 is a side view showing a rifle sling attachment swivel being engaged within a sling swivel receptacle to establish the latched condition of the firearm sling with respect to the firearm; and FIG. 6 is a view showing an alternative embodiment of the present invention, showing a central portion of a firearm sling having a non-separable connecting strap including a resilient section and having a strap receiving tension adjustment member.

DETAILED DESCRIPTION OF PREFERRED EMBODIMENT

Figure 1:
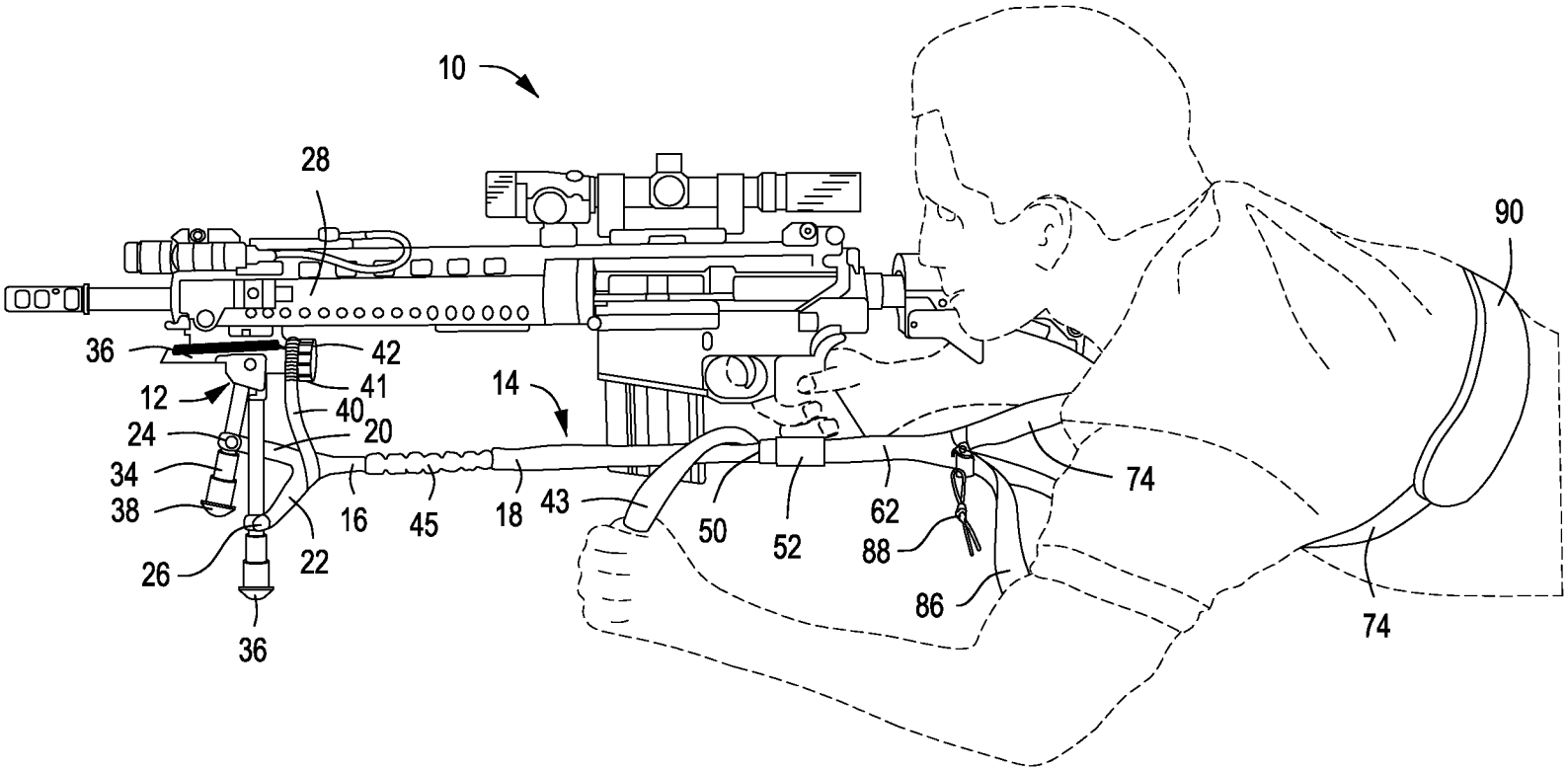

Referring now to the drawings and first to FIG. 1, a marksman, illustrated in broken lines, is shown in the prone aiming and shooting position, using a firearm, shown generally at 10, to which a bipod mechanism, shown generally at 12, is mounted. An integrated tension stabilization firearm sling, shown generally at 14, which embodies the principles of the present invention and represents the preferred embodiment, is shown in FIG. 1 to have tension applying connection both with the bipod mechanism 12 of the firearm, and with the body of the marksman, thereby providing the user with tension stabilized firearm positioning. The integrated tension stabilization firearm sling 14 has a firearm connector section, shown generally at 16, which is generally composed of flexible strap material. The firearm connector section 16 has a firearm or bipod attachment strap 18, which is preferably composed of a durable fabric material, such as the polymer material, Nylon, as are other strap components of the tension stabilizing sling system. The firearm attachment strap 18 includes bipod leg connecting portions 20 and 22 each having bipod connector loops 24 and 26 at respective terminus thereof that receive the respective legs of the bipod mechanism 12. It is to be understood, however, that the sling may be composed of any suitable flexible strap material, such as leather, a composite material or a suitable flexible polymer material, without departing from the spirit and scope of the present invention. Also, it should be understood that the use of the term "bipod" concerning the sling is not intended to restrict the use of the sling to use with firearms having bipods. The firearm sling of the present invention may be effectively employed for tension stabilization and recoil management of firearms that are not provided with bipods.

Figure 3:
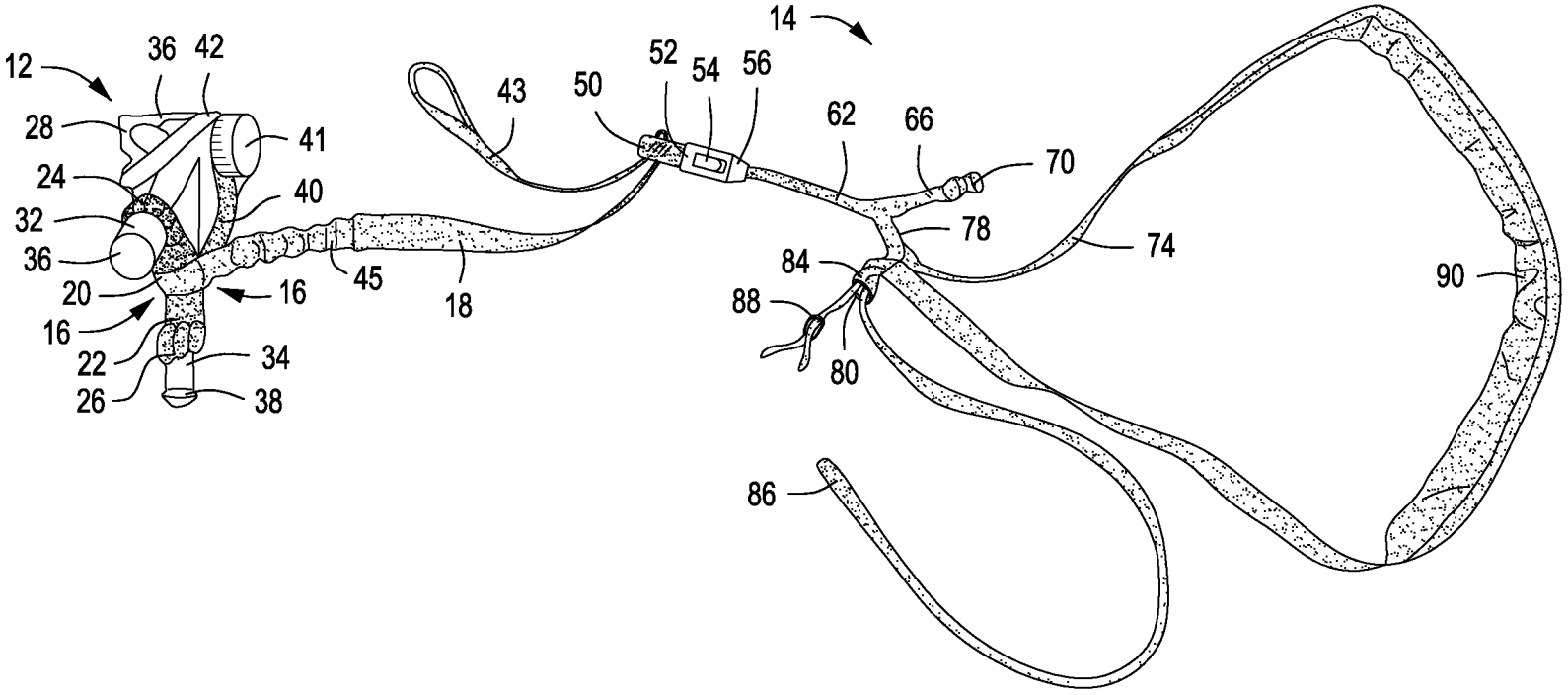

With reference to FIGS. 1 and 3, the bipod mechanism 12 is shown being mounted to the handguard 28 of the tactical rifle 10 and having bipod leg members 32 and 34 that project downwardly from a bipod mount 36 by which the bipod 12 is mounted to the handguard 28. The bipod leg members 32 and 34 are typically provided with foot members 36 and 38 that have slip resistant and wear resistant material such as rubber or rubber-like polymer mounted thereto.

Figure 2:
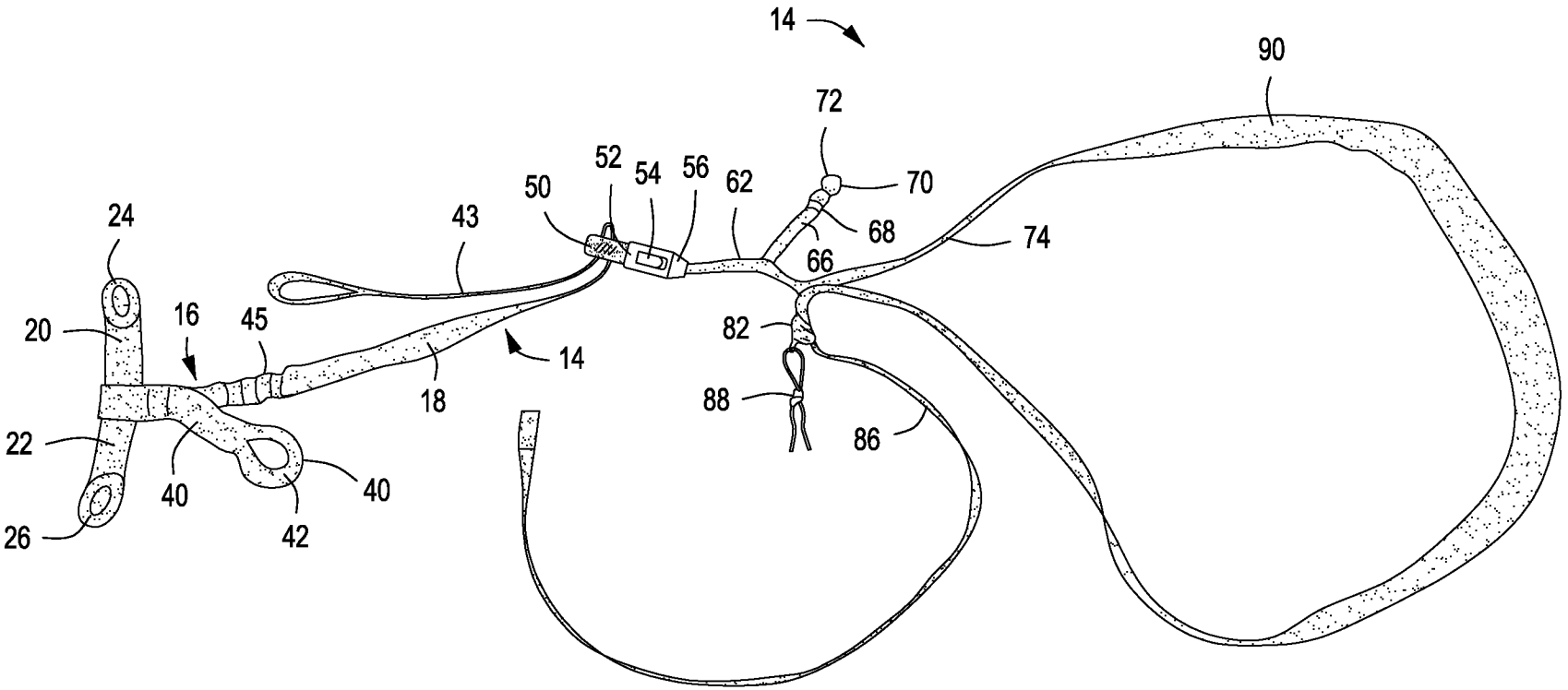

The bipod connector loops 24 and 26, which are best shown in FIG. 2, may be composed of a flexible material, such as a tubular fabric strap material and may have internal elastic band material, typically known as "bungie cord", within the tubular strap material to permit the loops to be expanded so as to pass over the foot members 36 and 38 of the bipod legs and provide releasable attachment of each of the bipod leg connecting portions 20 and 22 of the bipod attachment strap 18 to the bipod legs. It is not intended to limit the spirit and scope of the present invention to the use of bipod loops that are composed of flexible and resilient material, as shown in the preferred embodiment of FIGS. For example the bipod loops maybe composed of hook and loop type fastener material, typically known as Velcro, which can be in the form of straps that are simply wrapped about the lower portions of the bipod legs to provide for releasable attachment.

The firearm connector portion 16 of the preferred embodiment of the firearm sling 14 is also provided with a single strap connector section 40 that is fixed, such as by stitching, to the intermediate region of the bipod attachment strap 18. A connector loop 42 is provided at the free extremity of the single strap connector section 40 and provides for single point connection with a suitable sling connector device of a firearm. For example, the bipod 12 or its mount 36 may be provided with a tension knob 41 which receives the connector loop 42 of the single strap connector section 40. Other connection structure may also be provided at the forward part of a firearm and may receive the connector loop 42. The connector loop 42 can be of flexible and elastic construction as discussed above, in connection with connector loop members 22 and 24, or may have other suitable forms that permit single point attachment to any suitable structural feature of the forward part of a firearm. The single strap connector section 40 is particularly advantageous when the firearm is not equipped with a bipod, or when single point connection of the sling system to the forward part of the firearm is desired.

The bipod attachment strap 14 of the sling 10 preferably incorporates a flexible and resilient strap section 45 that is composed of a tubular fabric material having an internal resilient member that may be in the form of bungie cord or a like material. This feature permits the resilient strap section 45 to stretch when subjected to a traction force and to contract due to the elastic memory of the elastic material which is incorporated within the resilient strap section 45.

It should be borne in mind that it is not intended to limit the firearm sling of the present invention to a strap member that has a resilient strap section of the nature that is shown at 45 in the drawings. Though a resilient strap section is preferable and permits a user to accommodate the yieldable force of a resilient member of the strap, for purposes of simplicity and to minimize manufacturing costs, a strap section that is not resilient, and will not stretch or contract to any substantial extent, may be employed. A simple tension adjustment strap can be adjusted by the user of the firearm and will yield good results.

Figure 4:
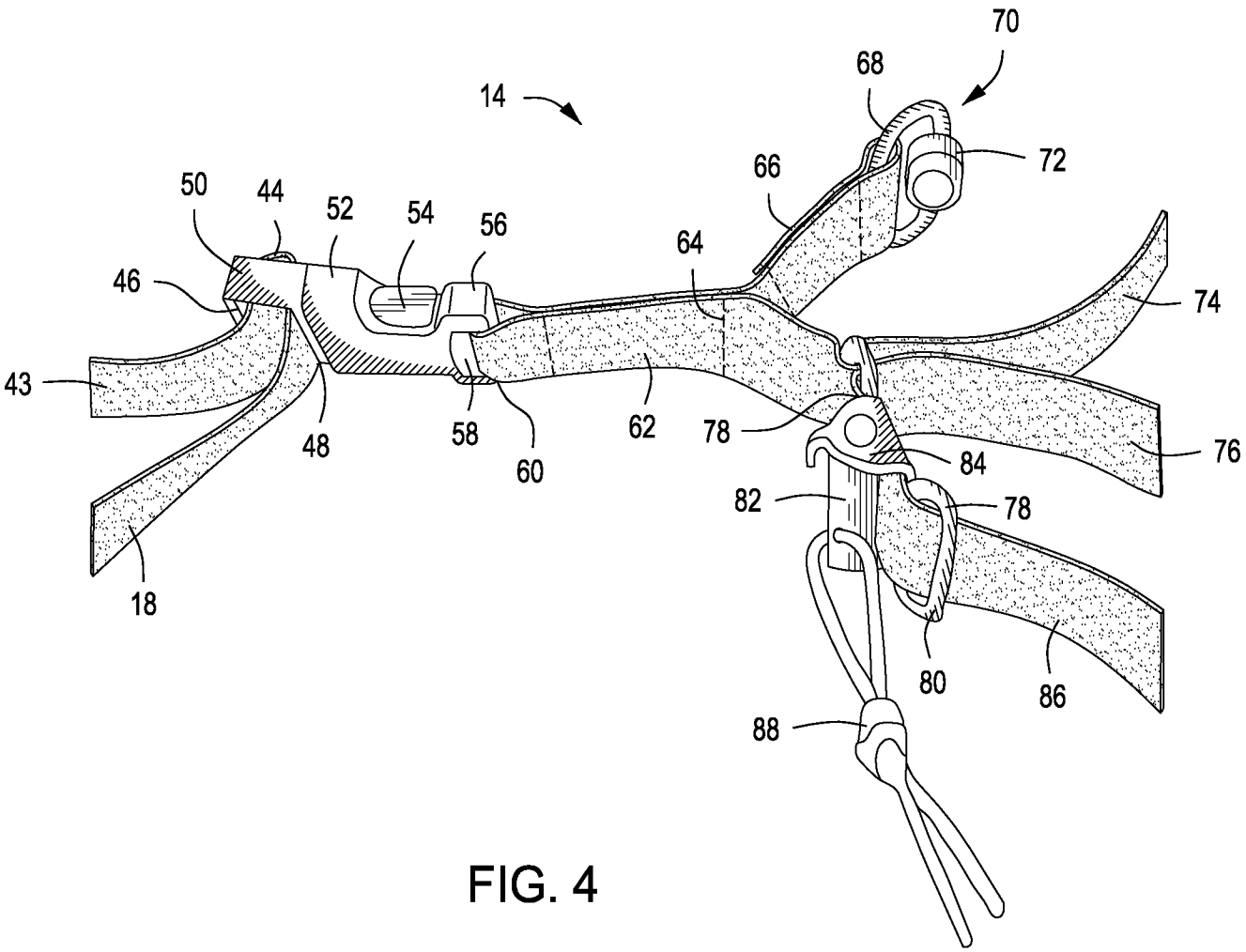

As best shown in FIG. 4, the adjustable strap member 18 extends through the adjustment openings 46 and 48 of a strap adjustment member 50 of quick disconnect connector 52, that is typically in the form of a conventional nick sack strap buckle. The free end portion 43 of the adjustable strap member 18 can be grasped by the firearm user and a manual pulling force can be applied to move the strap within the adjustment openings 46 and 48 to shorten the length of the adjustable strap member 18 and thereby tighten the firearm sling as desired. Tightening of the adjustable strap 18 can be easily done with the firearm user lying in the prone position or assuming any other bipod tension stabilized firearm position. The adjustable strap 18 may be lengthened as desired by moving the adjustment strap 18 in the opposite direction within the adjustment openings 46 and 48.

The quick disconnect rucksack strap connector member 52 defines a latching receptacle within which is received one or more connection and latch release members 54 that are typically composed of a polymer material. The connection and latch release members 54 are sufficiently flexible that they can be manually manipulated, by application of a manual compressing force, to release internal latch members and permit manual separation of the strap adjustment member 50 from within the body portion of the quick disconnect connector member 52. The quick disconnect rucksack strap connector member 52 also includes a strap connection member 56 having a strap receptacle opening 58 through which a loop portion 60 of the firearm sling is extended. The loop portion 60 is closed, such as by stitching, so that the loop portion is essentially mounted in non-adjustable fashion to the strap connection member 56. To establish assembly of the adjustable strap member 18 to a sling strap section 62, the ruck sack buckle type quick disconnect connector member is simply assembled in a manner causing the latches of the quick disconnect connector to engage within the internal latch receptacle of the strap connector member 52. Many latch devices that are presently on the market are engaged and disengaged in this manner and are composed of a polymer material having latching components of flexible character.

As shown particularly in FIG. 3 the strap section 62 may be composed of a two or more layers of web strap material that are connected by stitching 64. The strap section 62, in addition to forming the loop portion 60, also forms a strap section 66 that extends through a strap receptacle 68 of a releasable pin or button portion 70 of a swivel mount 72. The swivel mount pin or button 70 is adapted to be received by a swivel mount receptacle 71 of a firearm as shown in FIG. 5, thus providing a releasable connection point of the firearm sling with a firearm to facilitate carrying of the firearm by means of the sling. Attachment of the swivel mount pin 70 within the swivel mount receptacle 71 of the firearm makes it possible of the user to manually carry the firearm in the conventional manner. When it is desired to use the firearm in a sling tension stabilized manner, the swivel mount pin 70 will be simply released from its receptacle 71, thus permitting the sling tension to be applied between the forward part of the firearm and the body of the user for tension stabilized aiming and shooting activities.

A body strap section 74 of the firearm sling 14 is connected with the sling strap section 62, such as by stitching or by any other suitable means for non-adjustable connection, and is of sufficient length to extend about the upper portion of the torso of a user as shown in the side elevation view of FIG. 1. The body strap section 74 can be positioned across the back of the user and extend under both arms as shown, or part of the body strap section 74 can extend over a shoulder of the user, as desired for comfort and as determined by the aiming and firing position that is assumed by the user. The body strap section 74 of the firearm sling is also of sufficient length to provide an adjustment strap section 76 that extends through adjustment openings 78 and 80, as shown in FIG. 4, and beneath a spring loaded friction member 82 of a friction buckle 84. The terminal end 76 of the adjustment strap section of the body strap 74 is grasped and pulled by the user to move the adjustment strap through the friction buckle and tighten the body strap section about the torso of the user, as desired. The friction buckle, however, will permit this character of strap movement for body strap tightening, but will prevent strap movement in the opposite direction for strap loosening. To loosen the tension of the rifle sling system, the user will apply a pulling force to a lanyard member 86, causing pivoting movement of the friction member 82 of the friction buckle 84 to its friction release position against the force of its torsion spring, and allowing body strap movement through the friction buckle for loosening adjustment of the body strap section. A portion of the body strap section 74 is preferably provided with a section of cushioning material 88 that facilitates the comfort of sling use both in the firearm carry condition and in the tension stabilization condition.

When the ruck sack strap connector 50 is assembled and latched, and the push-button locking pin 70 of the pivot mount has been released and separated from its receptacle, the forward end portion of a firearm will be essentially anchored to the body of the user via the adjustable tension stabilization sling apparatus. The user will simply apply a pulling force to the tension adjustment end 46 of the tension adjustment strap section 18, thus increasing the tension force being applied by the sling system to the firearm and to the body of the user. The firearm tension stabilizing sling system 14 thus causes the firearm 10 to be drawn toward the user and establishes tight engagement of the buttstock of the firearm against the shoulder of the user so that the firearm is essentially fixed and stabilized relative to the body of the user, thereby facilitating efficient tension stabilized aiming and shooting of the firearm.

Use with Firearm having Bipod:

When the firearm being used is equipped with a bipod, such as is evident from the illustration of FIG. 1, the bipod connector loops 20 and 22 can be secured to the spaced, diverging legs of the bipod. The connector loops can be stretched or enlarged, such as by forcing the elastic loops over the feet of the bipod legs so that the loops and the bipod leg connecting portions 16 and 18 and the firearm or bipod attachment strap 14 will remain in assembly with the bipod legs regardless of the manner by which the firearm is handled. Alternatively, if the bipod connector loops are composed of a fastener material such as Velcro, the fastener material can simply be wrapped about each of the bipod legs. The connection loop 42 of the strap section 40 can also be assembled to the friction knob 41 of the bipod as shown in FIG. 3. At this point of the assembly process, the quick disconnect nick sack strap connector 50 will typically be disconnected to simplify assembly of the sling sections to the firearm and to the body of the user. At the time of firearm use, the user will assemble and latch the nick sack strap connector 50 and will then apply tension force to the adjustment strap section 46, thus tightening the straps 18 and 62 and moving the firearm sufficiently toward the user to engage the buttstock of the firearm tightly against the shoulder of the user. The tension of the assembled and tightened sling apparatus will cause the recoil force of the tension stabilized firearm to be efficiently managed and will quickly return the firearm substantially to the aiming and firing position following dissipation of the recoil shock force that occurs at the discharge of each round of ammunition.

Use for Single Point Firearm Connection:

If single point connection of the firearm sling to the firearm is desired, the connector loop 40 of the strap section 38 will be employed and the bipod connector loops 20 and 22 of the bipod leg connecting portions 16 and 18 of the bipod attachment strap will not be used. The connector loop 40 will be assembled to the friction knob 41 of the bipod 12 or to some other suitable structure of the forward end of the firearm. If the firearm is not equipped with a bipod, the connector loop will be attached to any other suitable structural component of the forward end portion of the firearm. For example, the connector loop 40 may be secured to the forward end portion of the handguard 28 of an AR-15 type tactical rifle.

The user of the firearm will then position the body strap section 74 about a selected portion of the user's torso and adjust it to the user's body, by apply a pulling force to the adjustment section 88 of the body strap section 74 or by loosening the body strap section via its adjustable position relative to the strap opening of the connector section 84.

Tension Stabilized Firearm Shooting Position:

With the firearm connector portion 12 of the firearm sling 14 in assembly with a forward part of the firearm, and with the body section 74 of the firearm sling positioned about a selected portion of the body of the user, the user can then assume the prone or any other bipod stabilized aiming and firing position as shown in FIGS. 4 and 5. After assuming a stabilized firearm position, the user will depress the button on the swivel mount 72, causing the releasable pin or button portion 70 to become unlatched from the firearm and providing a force resistance connection of the body section 74 and the firearm engaging section 16 of the sling assembly 14. At this point the firearm user may accomplish final adjustment of the sling assembly by selective pulling or adjustment of the strap sections 43 and 88 relative to the adjustable and releasable connectors 40 and 82, thus establishing desired positioning of the firearm sling components.

It is intended that the firearm sling assembly be capable of force applying attachment to a portion of a firearm, typically with a forward portion of a firearm, and that it be capable of selective adjustment for applying a pulling force to a firearm to cause the buttstock of the firearm to establish tight engagement with the shoulder of a user for tension stabilization of the firearm. This tight buttstock engagement will facilitate efficient and accurate aiming of the firearm and will cause the firearm to be returned substantially to its aiming position upon dissipation of the recoil force that occurs upon firing of a round of ammunition, ejection of a spent cartridge case and recharging the cartridge chamber of the firearm with a fresh cartridge. This feature ensures that minimum effort will be required, after firing each round of ammunition, to position the firearm so that the sighting device is substantially returned to the desired point on the target.

Although the tension stabilizing rifle sling system of the present invention is shown to have a firearm connection section 16 and a user's body strap section 74, these sections being connected by a quick disconnect ruck sack strap buckle, the use of a quick disconnect feature is not intended to be limiting of the spirit and scope of the present invention. It is only necessary that a connection and adjustment strap interconnect the firearm connection section 16 and the user's body strap section and that the effective length of the connection and adjustment strap be adjustable for adjusting the desired tension of the sling system. As shown in FIG. 6, the adjustment strap 18 of a tension stabilizing rifle sling system 90 is not separable and is received by a strap length adjustment mechanism 92 that is manually manipulated by the user to achieve a desired effective length of the adjustment strap and thus achieve the strap tension that is desired by the user for firearm stabilization and recoil management. Although the connection and adjustment strap 18 is shown to be folded for length adjustment, it should be borne in mind that the strap length adjustment mechanism 92 may be manipulated to roll a portion of the strap about itself and achieve the strap length adjustment that is desired for selection of desired sling tension.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A firearm sling enhanced method for aiming and shooting a firearm having a bipod with downwardly projecting bipod legs, comprising:

securing a first sling strap section of a firearm sling to the downwardly projecting bipod legs of a shoulder fired firearm, the first sling strap section having a pair of bipod connection straps each having releasable connection with one of the downwardly projecting bipod legs, the first sling strap section also having a first releasable connector through which said first sling strap section is adjustably extended to define a free end portion of the first sling strap section;

securing a second sling strap section of said firearm sling about the body of a user, said second sling strap section having a second releasable connector through which said second sling strap section is extended to define a second sling strap end;

establishing releasable connection of said first and second releasable connectors and establishing connection of said first and second sling strap sections; and adjusting said firearm sling by selective application of manual force to said first sling strap section free end portion to achieve desired relative positioning of said first and second sling strap sections of said firearm sling and the shoulder fired firearm to achieve sufficient tension to urge a buttstock portion of the shoulder fired firearm against a shoulder of the user with sufficient force to cause the tension force of said firearm sling and the body anatomy of the user to return the firearm substantially to the aiming position following dissipation of the recoil energy resulting from discharge of the firearm.

2. The firearm sling enhanced method of claim 1, wherein each of said bipod connection straps defines a bipod connector loop, said method comprising: extending each of said downwardly projecting bipod legs through said bipod connector loops of said bipod connection straps and establishing releasable connection of said bipod connection straps with the bipod legs.

3. The firearm sling enhanced method of claim 1, wherein the firearm bipod establishes a single point of firearm sling connection, said method comprising;

attaching a single strap connection member of said firearm sling to the single point of firearm sling connection; and upon said adjusting method step, said single strap connection member applying a tension force to said bipod and urging the buttstock of the firearm tightly against the shoulder of the user.

4. The firearm sling enhanced method of claim 1, wherein said second sling strap section of said firearm sling defines a body strap connector section having a body strap connector defining a body strap of sufficient length to extend about the back and under the arms of the user and defines a terminal end portion, said second sling strap section having a buckle member in assembly therewith receiving said terminal end portion of said body strap, said method step of securing a second sling strap section of said firearm sling about the body of the user comprising:

extending said body strap of said firearm sling about a selected portion of the torso of the user's body and extending said terminal end portion of said body strap through said buckle member; and applying a pulling force to said terminal end portion of said body strap for adjusting said body strap for desired tightness about the torso of the user's body.

* * * * *